United States Patent [19]

Homma

[11] Patent Number: 4,797,649

[45] Date of Patent: Jan. 10, 1989

[54] CIRCUIT BREAKER ACTUATED BY SHAPE MEMORY ALLOY

[75] Inventor: Dai Homma, Yokohama, Japan

[73] Assignee: Naomitsu Tokieda, Tokyo, Japan

[21] Appl. No.: 121,802

[22] Filed: Nov. 17, 1987

[30] Foreign Application Priority Data

Nov. 17, 1986 [JP] Japan ..... 61-271729

[51] Int. Cl.[4] ..... H01H 61/06; H01H 71/18

[52] U.S. Cl. ..... 337/140; 361/211

[58] Field of Search ..... 337/140; 361/24, 211

[56] References Cited

U.S. PATENT DOCUMENTS 3,858,141 12/1974 Lackey ..... 337/140

4,544,988 10/1985 Hochstein ..... 337/140

*Primary Examiner*—H. Broome

*Attorney, Agent, or Firm*—Birch, Stewart, Kolasch & Birch

[57] ABSTRACT

A circuit breaker includes first and second contactors having connecting/disconnecting means which normally keeps the two contactors in contact with each other. A shape memory alloy is mechanically connected to a predetermined portion of one of the connecting-/disconnecting means of one contactor is electrically connected in parallel with a device to be protected, e.g. an electric circuit or an electric element. When a voltage of a predetermined value or more is applied to the device being protected, a current of a predetermined value or more passes through the shape memory alloy, whereby the alloy is heated to produce its shape memory effect. A shape recovering force is applied to the connecting/disconnecting means of the on contactor in a predetermined direction to separate the contactors.

7 Claims, 3 Drawing Sheets

CIRCUIT BREAKER ACTUATED BY SHAPE MEMORY ALLOY

BACKGROUND OF THE INVENTION

1. Field of the Invention

This invention relates to circuit breakers and more particularly to a circuit breaker actuated by a shape memory alloy wherein, when a voltage applied to a device being protected, such as an electric circuit and electric element, reaches a predetermined value or more, circuit breaking action is performed.

2. Prior Art

A known circuit breaker has been developed in which the circuit breaker is connected in series with the device being protected and, when an electric current through the device protected reaches a predetermined value or more, the current is interrupted.

Such a conventional breaker has shortcomings as follows.

First, in certain types of circuits the relationship between the current and the voltage is not always predetermined, i.e. certain voltage can bring about various current values. Hence, in case where an overvoltage on the device being protected is to be prevented by a conventional circuit breaker, the circuit breaking action cannot always be performed accurately at a desired critical voltage.

Next, even under normal conditions, current passes through the circuit breaker, thereby causing electric power to be consumed therein to some degree.

Further, a relatively high current high is needed to actuate the circuit breaker.

Yet further, the circuit breaker is complicated in construction and high in manufacturing cost.

SUMMARY OF THE INVENTION

Accordingly, it is an object of the present invention to provide a circuit breaker in which the circuit breaking action is performed in direct response to a voltage applied to a device being protected, such as an electric circuit and an electric element.

Another object of the present invention is to provide a circuit breaker in which electric power is not consumed under normal operating conditions.

Another object of the present invention is to provide a circuit breaker in which breaking action can be performed with a very small current.

Still another object of the present invention is to provide a circuit breaker which can be used as a temperature fuse as well.

Further object of the present invention is to provide a circuit breaker which can be manufactured in low cost.

In accordance with the above objects, the present invention comprises a circuit breaker including first and a second contactors having connecting/disconnecting means normally maintaining the first and second contactors in contact with each other, but separates the first and second contactors from each other when a force of a predetermined value or more is applied to a predetermined portion thereof in a predetermined direction. A shape memory alloy is electrically connected in parallel with a device to be protected, being mechanically associated with a predetermined portion of the connecting-/disconnecting means and and being operable to apply the force to the predetermined portion in the predetermined direction when the shape memory effect is generated therein.

According to the present invention, if it is assumed that an impedance of the shape memory alloy is set at a value sufficiently higher than an impedance of the device being be protected under the normal condition, then, substantially no current passes through the shape memory alloy under the normal condition. Therefore, the shape memory alloy is not heated, and does not exhibit its shape recovering force, so that the connecting/disconnecting means keeps the first and second contactors in contact with each other.

However, when an overvoltage is applied to the device being protected due to some abnormal condition, a voltage across opposite ends of the shape memory alloy becomes high and the current passing through the shape memory alloy increases, whereby the alloy is heated by the Joule heat to a martensitic critical temperature at which the shape memory effect is generated therein, or more. For this, due to the shape memory effect, the shape memory alloy applies the shape recovering force to the predetermined portion of the connecting/disconnecting means in the predetermined direction, whereby the contactors connecting/disconnecting means separates the first and second contactors from each other. Accordingly, the device being protected is cut off from the a power source, and is thereby protected from the overvoltage.

Consequently, in this circuit breaker, the circuit breaking action is performed in direct response to the voltage applied to the device being protected.

Furthermore, since this circuit breaker is connected in parallel with the device being protected which has much greater impedance than that of the circuit breaker, under the normal operating conditions, almost no current passes through the circuit breaker, so that the substantially no power is consumed therein.

Additionally, because only a very small current is needed for generating the shape memory effect in the shape memory alloy, the circuit breaking action can be performed by a very small current.

BRIEF DESCRIPTION OF THE DRAWINGS

The foregoing and other objects, features and advantages of the present invention will become apparent from the following detailed description when taken in connection with the accompanying drawings. It is to be understood that the drawings are designed for the purpose of illustration only and are not intended as a definition of the limits of the invention.

DETAILED DESCRIPTION

Figure 1:
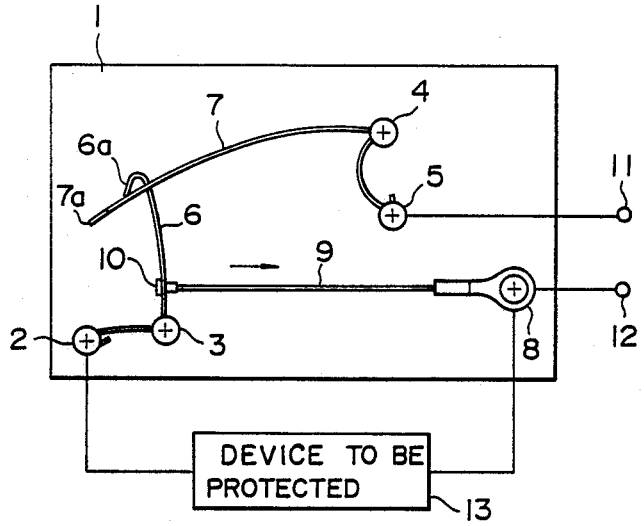
FIG. 1 is a plan view showing one preferred embodiment of the circuit breaker according to the present invention in a connected state.

The present invention will hereunder be described in conjunction with the preferred embodiments shown in the drawings.

Figure 2:
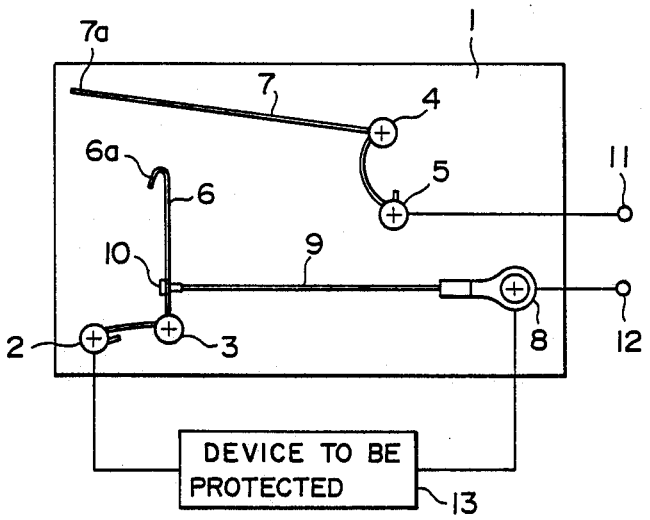
FIG. 2 is a plan view showing the above preferred embodiment in an open circuit state.
Figure 3:
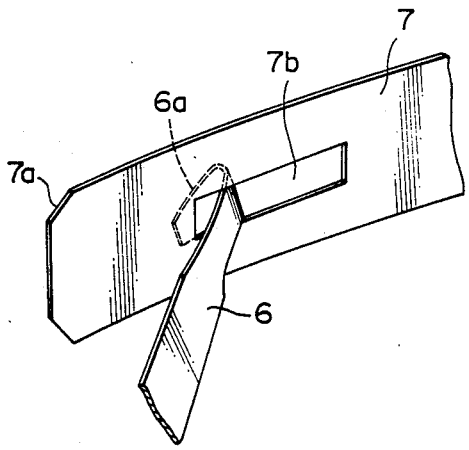
FIG. 3 is a perspective view showing an engaged portion between the first and second points in the above preferred embodiment.

FIGS. 1 to 3 show one preferred embodiment of the present invention. In this embodiment, mounting screws 2, 3, 4 and 5 are inserted in a base plate 1. The mounting screws 2 and 3 are secured thereto with a leaf spring-like first contactor 6 made of a good conductor material with high elasticity. One end portion of this first contact member 6 is formed to include a free end curved to form a hook portion 6*a*. The mounting screws 4 and 5 are secured thereto with a leaf spring-like second contactor 7 formed of a good conductor material with high elasticity. This second contactor 7 of which one end portion 7*a* being a free end is provided at a position close to the free end 7*a* with an elongated rectangular slot 7*b* as shown in FIG. 3. Then, the hook portion 6*a* of the first contactor 6 may be engaged with and as well disengaged from the slot 7*b*. In this embodiment, the first and second contactors 6 and 7, themselves constitute the connecting/disconnecting means.

An alloy mounting terminal 8 is fixed to the base plate 1. A wire-shaped shape memory alloy 9 formed of a Ti—Ni alloy is fixed to the terminal 8 at one end portion thereof. The other end portion of the alloy 9 is fixed to the intermediate portion of the first contactor 6 through a fixture 10, whereby the shape memory alloy 9 is mechanically and electrically connected to the first contactor 6. Here, when the hook portion 6*a* of the first contactor 6 is engaged with the second contactor 7 as shown in FIGS. 1 and 3, the shape memory alloy 9 is extensionally deformed or elongated from an original memory length.

Designated at 11 and 12 are power input terminals. One of the input terminals 11 is connected to the second contactor 7. The other of the input terminals 12 is connected to one end of the shape memory alloy 9 through the alloy mounting terminal 8 and to the one end of a device 13 to be protected, such as an electric circuit and an electric element. Furthermore, the other end of the device 13 is connected to the first contactor 6. With this arrangement, the shape memory alloy 9 is connected in parallel with the subject 13 to being protected. Hereupon, it is assumed that an impedance of the shape memory alloy 9 is set at a value sufficiently higher than an impedance of the device 13 under normal operating conditions.

Operation of this preferred embodiment is substantially as follows.

In using this circuit breaker, first, as shown in FIGS. 1 and 3, the hook portion 6*a* of the first contactor 6 is inserted through the engageable slot 7*b* of the second contactor 7 and the hook portion 6*a* is hung on the peripheral edge portion of the engageable slot 7*b*. In this state, the second contactor 7 is flexed in an arcuate shape, and the hook portion 6*a* of the first contactor 6 and the second contactor 7 are in firm contact with each other through the resiliency of the both contactors 6 and 7.

As described above, under normal operating conditions, the impedance of the shape memory alloy 9 is sufficiently higher than the impedance of the subject 13 to be protected, therefore, almost no current passes through the shape memory alloy 9. Accordingly, the shape memory alloy a is not heated, whereby a shape recovering force is not generated therein, so that the hook portion 6*a* of the first contactor 6 and the second contactor 7 are kept in contact with each other.

However, when an overvoltage is applied to the device 13 being protected due to some abnormal situation, the voltage across the opposite ends of the shape memory alloy 9 is increased as well, so that the alloy 9 is heated by the Joule heat to its critical temperature or more. Consequently, due to the shape memory effect, the shape memory alloy 9 tends to restore to the original length remembered i.e. shorten thereby pulling the first contactor 6 in a direction indicated by an arrow in FIG. 1, whereby the hook portion 6*a* of the first contactor 6 and the second contactor 7 are disengaged from each other and the hook portion 6*a* is caused to come off from the engageable slot 7*b*, so that the first and second contactors 6 and 7 are separated from each other as shown in FIG. 2. With this arrangement, the subject 13 to be protected is disconnected from the power source, thereby being protected from the overvoltage.

As a result, in this circuit breaker, the circuit breaking action is performed in direct response to the voltage applied to the device 13 being protected.

Furthermore, this circuit breaker is connected in parallel with the 13, and under normal conditions almost no current passes through the shape memory alloy 9, whereby substantially no power is consumed in the circuit breaker.

Since only a very small current is needed for generating the shape memory effect in the shape memory alloy, circuit breaking action can be performed by a very small current.

Furthermore, if this circuit breaker is used in combination with a conventional circuit breaker, then the device 13 can be protected directly in response to both the voltage and the current.

Figure 4:
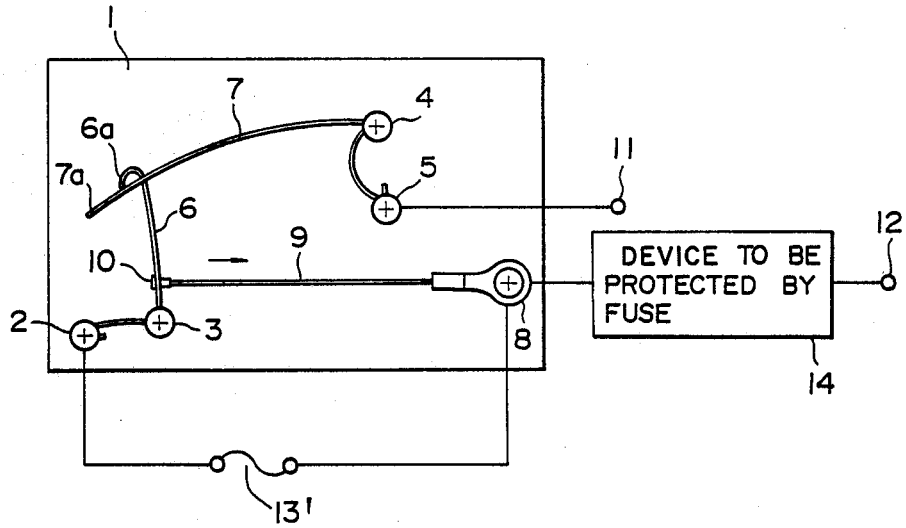
FIG. 4 is a plan view showing a circuit where the device being protected is a fuse in the above preferred embodiment.
Figure 5:
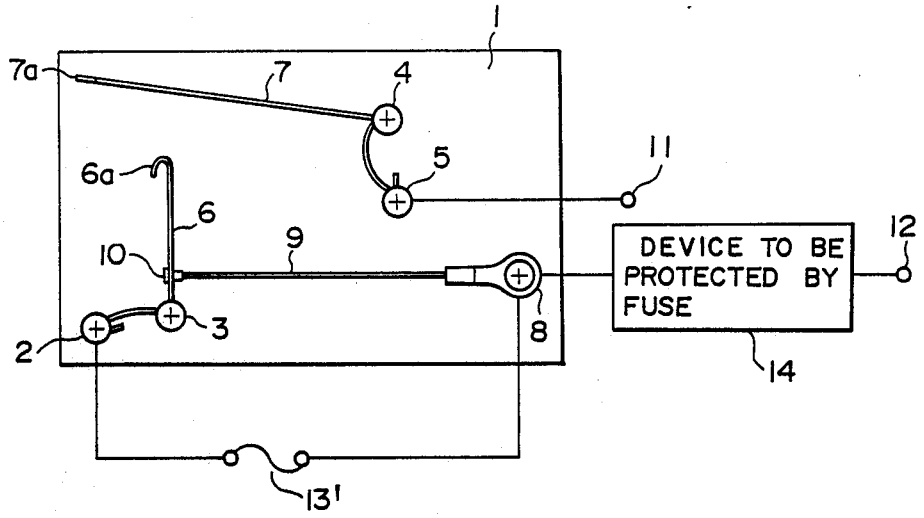
FIG. 5 is a plan view showing the circuit of FIG. 4 in a state where the circuit breaker has completed circuit breaking.

FIGS. 4 and 5 show the case where, in the above preferred embodiment, the device to be protected is a fuse, the fuse is designated by a reference numeral 13'. The device 14 to be protected by the fuse 13' is connected in series with the shape memory alloy 9 and the fuse 13', respectively.

Heretofore there has been well known a system wherein, to evade the troublesome replacement of a blown fuse with a new one, a circuit breaker is used in combination with the fuse, and, when an overcurrent passes through the fuse and the circuit breaker, the circuit breaking action is performed by the circuit breaker before the fuse is blown. Usually, most of the conventional circuit breakers of this type have used a bimetal to connect and disconnect their contact points. However, with such circuit breakers, there arises a disadvantage that much labor is required for making adjustment to the bimetal to accurately set a threshold value of the current at which the circuit breaking action is performed.

However, using a circuit breaker according to the present invention in such a manner as shown in FIGS. 4 and 5 can obviate the aforesaid disadvantage.

More specifically, under the normal operation, an electric resistance of the shape memory alloy 9 is sufficiently higher than an electric resistance of the fuse 13', whereby substantially no current passes through the alloy 9. Accordingly, the shape memory alloy 9 is not heated and the shape recovering force is not generated therein, so that the hook portion 6*a* of the first contactor 6 and second contactor 7 are kept in contact with each other. In general, however, when a current through a fuse approaches a critical value, temperature of the fuse is increased by the Joule heat, so that the electric resistance of the fuse is abruptly raised. Accordingly, when the current through its fuse 13' approaches the fusing current value, the voltage across the opposite ends of the fuse 13' is abruptly raised and the current through the shape memory alloy 9 is increased, so that the alloy 9 is heated by the Joule heat to its critical temperature or more. Consequently, due to the shape memory effect, the shape memory alloy 9 tends to restore to the original length remembered thereby pulling the first contactor 6 in a direction indicated by an arrow in FIG. 4, whereby the hook portion 6*a* of the first contactor 6 and second contactor 7 are disengaged from each other and hook portion 6*a* is caused to come off from the engageable hole 7*b*, so that the first and second contactors 6 and 7 are separated from each other as shown in FIG. 5.

Thus, the fuse 13' and the subject 14 to be protected by the fuse 13' are disconnected from the power source, so that the device 14 can be protected from the overcurrent without blowing of the fuse 13'.

In this circuit breaker, regardless of the value of the fusing i.e. critical current of the fuse 13', when a current through the fuse 13' comes to close in value to the fusing current of the fuse 13', a large current passes through the shape memory alloy 9, causing the circuit breaking action as described above. For this, there is no need of troublesome adjustment of the parts in accordance with the value of the fusing current of the fuse 13' as in the case of the conventional circuit breaker using the bimetal. In other words, in this circuit breaker, design of the circuit breaker and adjustment of the products can be performed irrespective of the value of the fusing current of the fuse 13', thus enabling one to obtain a very high productivity.

Furthermore, when the critical temperature at which the shape memory alloy 9 generates the shape memory effect therein is properly set, the shape memory alloy 9 also can function as a temperature fuse. In other words, not only when the current through the fuse 13' is high, but also when the environmental temperature becomes abnormally high, this circuit breaker can perform the circuit breaking action as well.

Figure 6:
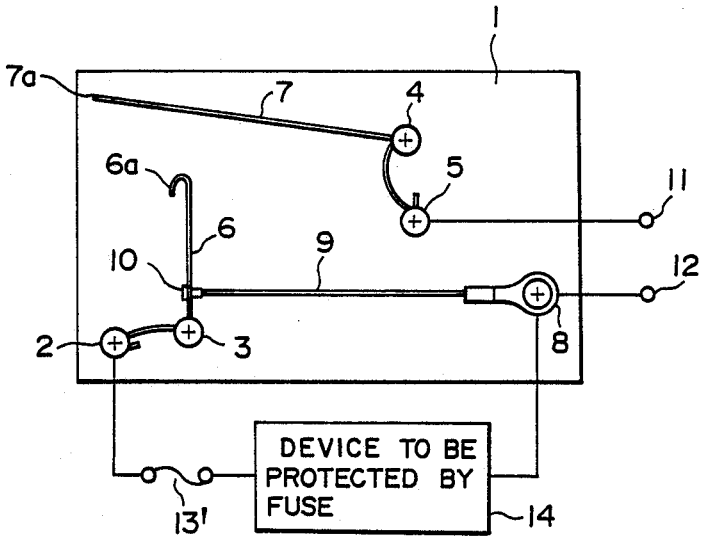
FIG. 6 is a plan view showing a modification of the circuit shown in FIGS. 4 and 5.

It should be noted that the subject 14 to be protected by the fuse 13' may be connected, as shown in FIG. 6, in parallel with the shape memory alloy 9 and in series with the fuse 13'.

Furthermore, according to the present invention, the connecting/disconnecting means i.e. the means for normally keeping the first and second contactors in contact with each other, and for continuously separating the first and second contactors from each other when the force of the predetermined value or more is applied to the predetermined portion thereof in the predetermined direction, need not necessarily be limited to the arrangement as in the above preferred embodiment, and any other arrangement which performs the function equivalent thereto can be used.

Furthermore, although, in the above preferred embodiment, the shape memory alloy formed of the Ti—Ni alloy is used, in the present invention shape memory alloys of any other types may be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A circuit breaker for protecting an electrical device comprising:

a first and a second contactor having respective connecting/disconnecting means for normally keeping said first and second contactors in contact with each other, and for continuously separating said first and second contactors from each other when a mechanical force of a predetermined value is applied to said means in a predetermined direction; and a shape memory alloy electrically connected in parallel with said device being protected, said alloy further being mechanically coupled to said means for applying said force in said predetermined direction when the shape memory effect is generated therein.

2. A circuit breaker as recited in claim 1, wherein said shape memory alloy is of a wire shape, and when said first and second contactors are in contact with each other, said shape memory alloy receives an elongation from an original memory length.

3. A circuit breaker as recited in claim 1, wherein:

said connecting/disconnecting means of said first contactor comprises a leaf spring member, and wherein one end portion thereof forms a free end curved to form a hook portion;

said connecting/disconnecting means of said second contactor comprises another leaf spring member, one end portion thereof forming a free end including an engageable slot thereat, said engageable slot being engageable with said hook portion of said first contactor in a state where said first and second contactors are elastically deformed; and when said engageable slot is engaged with said hook portion, if said force in said predetermined direction is applied to said leaf spring member of said first contactor by said shape memory alloy, then said engageable slot and said hook portion are disengaged from each other.

4. A circuit breaker as recited in claim 3, wherein:

said shape memory alloy is of a wire shape, one end of which is mechanically and electrically connected to said leaf spring member of said first contactor; and when the hook portion of said first contactor is engaged with said engageable slot of said second contactor, said shape memory alloy receives an elongation from an original memory length.

5. A circuit breaker as recited in claim 1, wherein an impedance of said shape memory alloy is set at a value relatively higher than an impedance of said device being protected.

6. A circuit breaker as recited in claim 1, wherein said subject to be protected is a fuse.

7. A circuit breaker as recited in claim 1, wherein said shape memory alloy is formed of a Ti—Ni alloy.

* * * * *